US005644678A

United States Patent [19]

Di Ronza

[11] Patent Number: 5,644,678

[45] Date of Patent: Jul. 1, 1997

[54] METHOD OF ESTIMATING VOICE PITCH BY ROTATING TWO DIMENSIONAL TIME-ENERGY REGION ON SPEECH ACOUSTIC SIGNAL PLOT

[75] Inventor: Benedetto Giuseppe Di Ronza, Bari, Italy

[73] Assignee: Alcatel N. V., Amsterdam, Netherlands

[21] Appl. No.: 184,277

[22] Filed: Jan. 20, 1994

[30] Foreign Application Priority Data

Feb. 3, 1993 [IT] Italy ..... MI93A0169

[51] Int. Cl.[6] ..... G10L 9/00

[52] U.S. Cl. ..... 395/2.16

[58] Field of Search ..... 395/2.15, 2.16, 395/2.17, 2.18, 2.42, 2.43, 2; 381/49, 46, 41, 43

[56] References Cited

U.S. PATENT DOCUMENTS 5,216,747 6/1993 Hardwick et al. ..... 395/2

5,313,553 5/1994 Laurent ..... 395/2.16

FOREIGN PATENT DOCUMENTS 0125423 11/1984 European Pat. Off. .

0127729 12/1984 European Pat. Off. .

0248593 12/1987 European Pat. Off. .

OTHER PUBLICATIONS

Dubnowski, J.; Schater, R., Rabiner, L., *Real Time Hardware Pitch Detector,* IEEE Trans on Acoustic, Speech and Signal processing, vol. ASSP., 24, No. 1, Feb., 1970.

*Primary Examiner*—Allen R. MacDonald

*Assistant Examiner*—Robert Mattson

*Attorney, Agent, or Firm*—Ware, Fressola, Van Der Sluys & Adolphson LLP

[57] ABSTRACT

A method of estimating the pitch of a speech acoustic signal in a time interval in which said signal is a voiced one, wherein the pitch corresponds to the distance between the contact points of a circle and a plot, normalized to a limit value, of the energy of said speech acoustic signal as a function of time; said contact points being obtained by rolling said circle on said plot.

18 Claims, 2 Drawing Sheets

METHOD OF ESTIMATING VOICE PITCH BY ROTATING TWO DIMENSIONAL TIME-ENERGY REGION ON SPEECH ACOUSTIC SIGNAL PLOT

TECHNICAL FIELD

The present invention relates to a method of estimating the pitch of a speech acoustic signal and to a speech recognition system using the same.

BACKGROUND OF THE INVENTION

Over the last years, the need for very different apparatuses with speech recognition has been dramatically increased; mobile telephone sets installed inside cars are a typical example of the increased need.

Recognition is based upon the extraction of a number of time variable parameters—among which the pitch—from the speech acoustic signal.

The overall reliability of the system hence depends on the reliability with which such parameters are estimated.

Several efforts are being made to obtain the optimal method of estimating the pitch, but at the present time a quite satisfactory method has not been found yet.

One category of such methods is called PAD (Peak Amplitude Detector) and is based on time scanning of the speech acoustic signal in search of a pair of peaks which comply with given characteristics; the time distance between the two peaks corresponds to the searched pitch.

As none of the known algorithms is fully satisfactory, each for several reasons: such as because it requires complicated and requires long calculations and, consequently, it is either not suitable for use in real time or requires very complicated and expensive calculation systems, because it is necessary to consider the speech signal for long times, because, in case of an error in estimate, such error drags itself on the following estimates, and so on.

SUMMARY OF THE INVENTION

It is an object of the present invention to overcome the drawbacks of the known art.

This object is reached through the method of estimating the pitch of a speech acoustic signal consisting of estimating the pitch of a speech acoustic signal in a time interval in which said signal is a voiced one, characterized in that the pitch corresponds to the distance between the contact points of a circle and a plot, normalized to a limit value, of the energy of said speech acoustic signal as a function of time, said contact points being obtained by rolling said circle on said plot, further comprising sampling, according to a sampling period, diseretizing and digitizing, according to a code, the energy of said signal, at least in said first interval, thus obtaining a sequence of binary values, normalizing said binary values to a limit value, determining a first relative maximum of said binary value normalized sequence, computing the formula: (1) $h(z)=\text{sqrt}\,[R^2-n^2]+E(x)-\text{sqrt}\,[R^2-(z-n)^2]$, where x is the position in said sequence of said first maximum, E(x) is the binary value of said first maximum, R is a parameter having a predetermined value, n is equal to an initial value, for values of z in the interval [1 . . . n+R], checking if there is at least one value of z such that the conditions (2) $E(x+z)\geqq E(x+z-1)$, (3) $E(x+z)\geqq E(x+z+1)$, and (4) $E(x+z)\geqq h(z)$, are met, and repeating the steps of (1), (2), (3) and (4) with an increased value of n until such check has a positive outcome or n=R, whereby, if such check has a positive outcome, said pitch corresponds to the value of z so determined. Another object is a speech recognition method using the above methodology, wherein the determination of whether the first time interval is a voiced interval includes verifying if it is of silent type by controlling the energy of the speech acoustic signal so that it does not exceed a first threshold in said interval, and verifying if it is of unvoiced type by controlling, for each sub-interval of predetermined length of such interval, that the absolute energy of said speech acoustic signal does not exceed a second threshold and, at the same time, that the energy of said speech acoustic signal is null in a number of time instants greater than a third threshold, whereby said check has a positive outcome if both verifications (of verifying if it is of silent type by controlling the energy of the speech acoustic signal so that it does not exceed the first threshold in said interval, and verifying if it is of unvoiced type by controlling, for each sub-interval of predetermined length of such interval, that the absolute energy of said speech acoustic signal does not exceed the second threshold and, at the same time, that the energy of said speech acoustic signal is null in a number of time instants greater than a third threshold) have a negative outcome.

The method of the present invention operates on the peaks of the speech acoustic signal realizing a search of peaks through the scanning of a time-energy two-dimensional region.

The method is easy to implement and can be realized in real time also with rather simple calculation systems.

The self-corrective capacities are very interesting: in fact it has been discovered that an erroneous estimate affects only the subsequent two or, at most, three estimates and anyway there is the tendency to always go back to the correct pitch.

The results of tests carried out on the present method were 90 percent successful.

BRIEF DESCRIPTION OF THE DRAWINGS

The present invention will become more apparent from the following not limiting description taken in conjunction with the attached drawings in which.

BEST MODE FOR CARRYING OUT THE INVENTION

Before going on with the description of the present invention, it is necessary to better explain the concept of pitch.

The speech acoustic signal can be considered as an approximately periodic signal if it is divided into small enough, e.g. 20 ms, time intervals; if a spectrum analysis is carried out, a number of spectral components are obtained; the spectral component with the lower frequency has a period corresponding to the one of the speech acoustic signal. Such a period is called pitch. Naturally such analyses are complicated by the presence of noise and by an imperfect periodicity.

The method, subject of the present invention, for estimating the pitch of a speech acoustic signal in a first time interval in which such signal is a voiced one, comprises the steps of:

a) sampling, according to a sampling period, to form discrete values and digitizing the discrete values, according to a code, the energy of the signal, at least in such first interval, thus obtaining a sequence of binary values, b) normalizing such binary values to a limit value, c) determining a first relative or local maximum of such normalized sequence of binary values, d) computing the formula $$h(z)=sqrt\,[R^2-n^2]+E(x)-sqrt\,[R^2-(z-n)^2],$$

where x is the position of the first maximum in such sequence,

E(x) is the binary value of the first maximum,

R is a parameter having a predetermined value, n is equal to an initial value (e.g. 1), for values of z in the interval (1. . . n+R), e) checking if there is at least one value of z such that the following conditions are satisfied:

$$E(x+z)\geqq E(x+z-1),\ E(x+z)\geqq E(x+z+1),$$

$$E(x+z)\geqq h(z),$$

and f) repeating steps d) and e), with an increased (e.g. by 1) value of n, until such check has positive outcome or n=R;

whereby, if the outcome of such check is positive, the pitch corresponds to the value of z so determined. Sqrt . . . means the square root function. Steps d) and e) are not to be intended, in a strictly literal sense, as sequential but they are to be intended in the sense that for values of z choosen in the interval 1 . . . n+R the formula is computed and step e) is carried out, and as soon as such check has a positive outcome, it stops; this of course does not exclude that one may compute the formula in advance for all the values of the interval and carry out all checks afterwards.

Notwithstanding the formulation of the method in such terms looks rather complicated, the method lends itself to a more general formulation and to a particularly effective graphical representation: the pitch corresponds to the distance of contact points between a circle and the plot, normalized to a limit value, of the energy of the speech acoustic signal as a function of time, obtained by rolling the circle on the plot.

Figure 1:
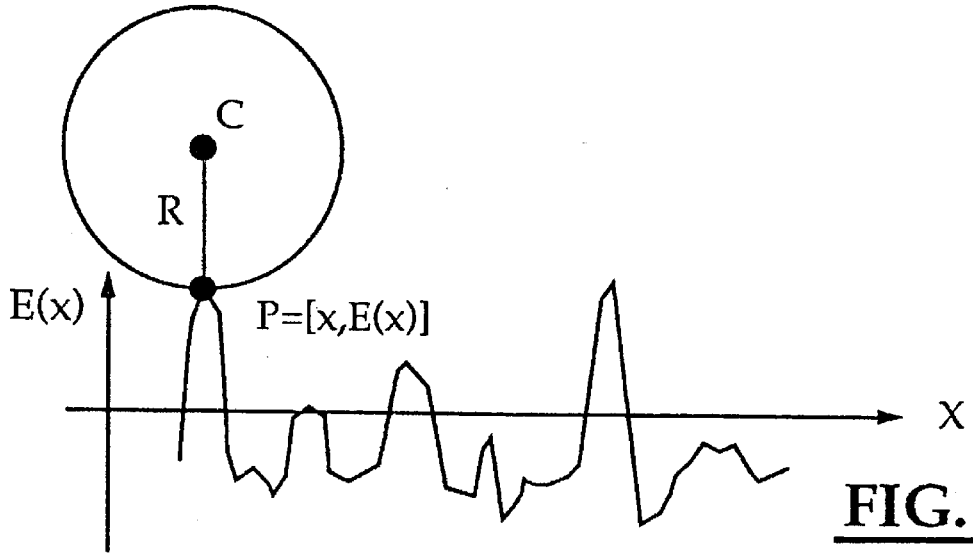
FIG. 1 shows a graphical representation of a first step of the present invention.
Figure 2:
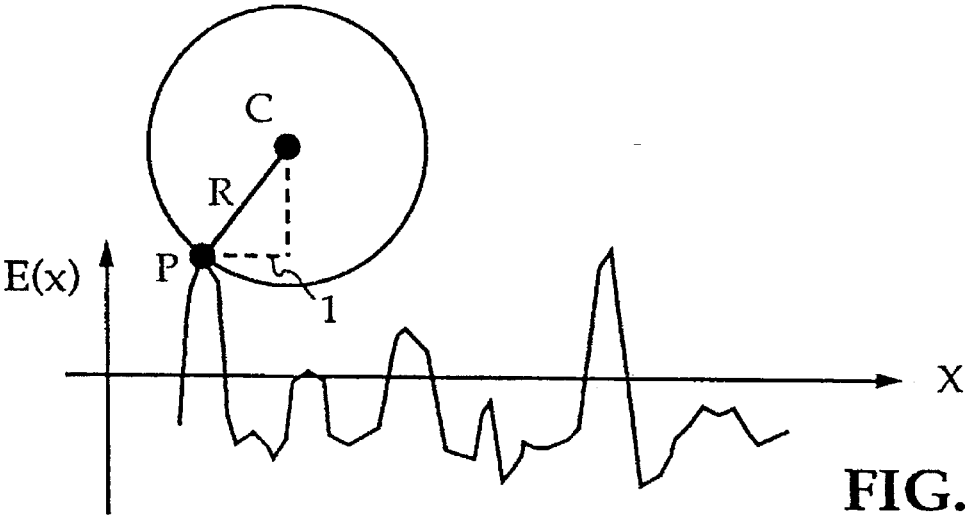
FIG. 2 shows a graphical representation of a second step of the present invention.
Figure 3:
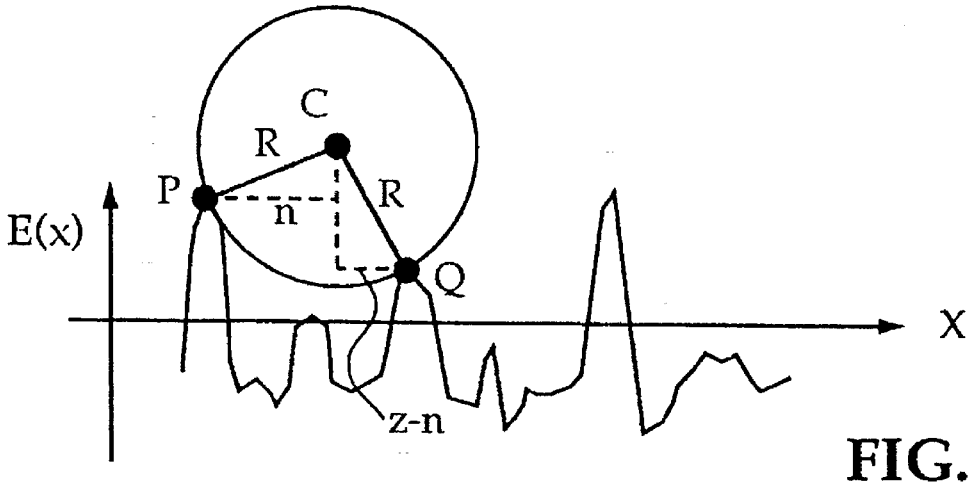
FIG. 3 shows a graphical representation of a third step of the present invention.

FIG. 1 shows a plot, normalized to a limit value, of the energy of a speech acoustic signal vs. time; there are peaks, which are relative maxima of the plot, having different height: the higher peaks are given by the spectral component of lower frequency also called the fundamental frequency. Then a relative maximum point P is chosen and the subsequent relative maximum point due to the fundamental frequency is determined. Point P has its coordinates x and E(x) (energy of signal at x). On such a plot at point P a circle of radius R and center C=[x,E(x)+R] is drawn so as to be tangent to the plot. At this point the circle is rotated about point P so that the abscissa of center C is increased by 1 unit, and it is checked if the circle so rotated crosses the plot, as illustrated in FIG. 2. The two previous operations are repeated until either the circle leans on the plot or the abscissa f center C is increased with respect to x by a value equal to radius R (which means until center C is at the same level as point P). In FIG. 3 the event is shown in which the circle after n repetitions contacts the plot at point Q. Point Q does not mathematically coincide with the relative maximum, but, under conditions valid for the voice acoustic signal, the error made is extremely small and, therefore, negligible. Point Q is a time equal to Z far away from point P and this time corresponds to the desired pitch.

The rotation of such circle, more precisely, of a variable arc of such a circle, individuates a two-dimensional region in the time-energy plane; the method realizes the search of the relative maximum through the scanning of such two-dimensional region.

Naturally the circle can be rotated rightwards, or leftwards, or both directions and then the effective pitch can be considered as the average of the two pitches so obtained. Such practice is a little more difficult to realize if one operates in real time, since it is necessary then to use a buffer capable of storing the samples of the speech acoustic signal. Formulas indicated at steps a) to f) illustrated above are still valid as long as the sequence of binary values is considered as ordered in a time reversed direction.

Naturally such a graphical method to be realized through a calculation system inside e.g. a speech automatic recognition system, requires adaptation, alternatives are clearly possible.

In an embodiment, which has proved to give good results, the speech acoustic signal has been sampled at a rate of 8,000 samples per second, and each sample has been converted into a 16-bit binary number comprised between −32767 and +32767 using a linear conversion code. The binary values of the sequence so obtained have been normalized in the interval [0 . . . 255].

The length of the first time interval must be chosen in such a way that at least two relative maxima corresponding to the fundamental frequency fall inside it; in practice the human voice pitch may vary from a minimum value INF equal to 2.5 ms to a maximum value SUP equal to 13.5 ms and therefore such first interval shall not be less than SUP.

The optimal value of the circle radius R has to be chosen through experimentation; the value that has given the best results in the embodiment was 13.25 ms. This value provides good results apart from the tone of the speaker that generates the speech acoustic signal.

Surely, if the class of speakers were, a priori, more restricted, e.g. only female speakers, there would be a different optimal value. Nothing prevents from varying, during operation of the speech recognition system, such a varied value depending on the tone of the speaker.

Figure 4:
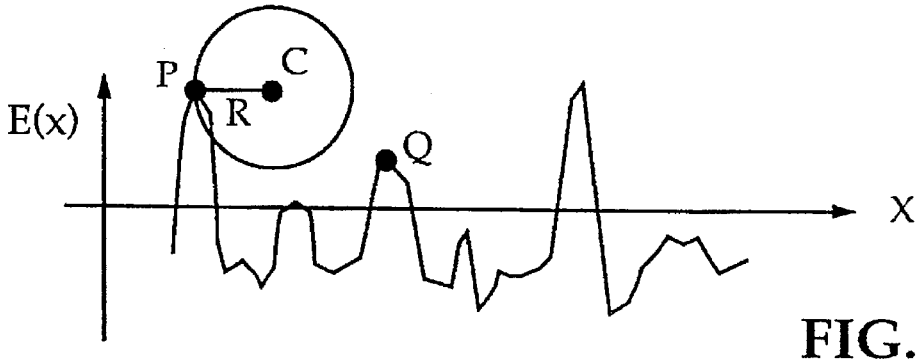
FIG. 4 shows a graphical representation of an example of an inappropriate choice of some parameters in the present invention.
Figure 5:
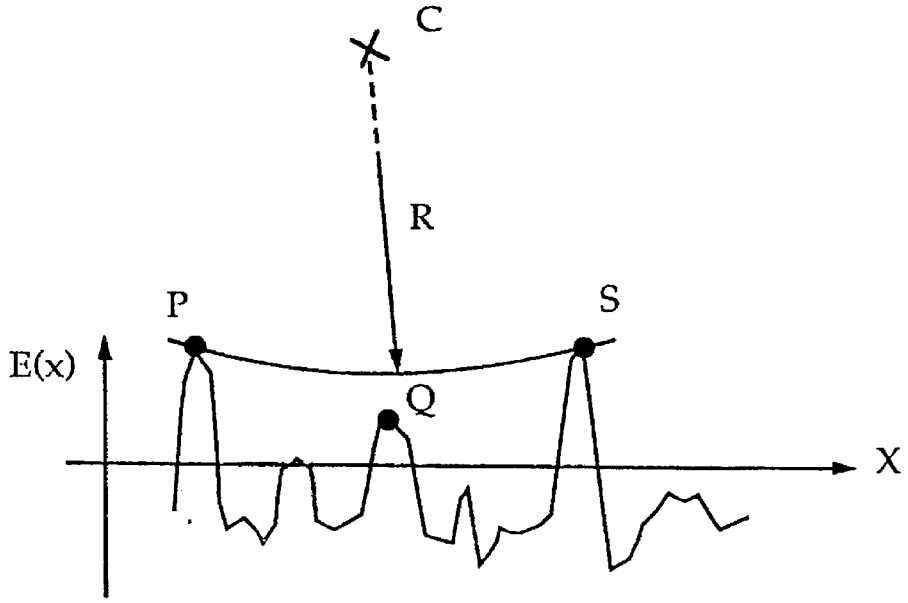
FIG. 5 shows a graphical representation of another example of an inappropriate choice of some parameters in the present invention.

A wrong choice of the value of radius R may lead to situations illustrated in FIGS. 4 and 5: In FIG. 4 a too small value of R leads to a not-reaching of the following local maximum point Q. In FIG. 5 a too large value of R leads to the reaching of a local maximum point S following point Q and therefore to an overestimate of the pitch.

Since the circle is applied and rolled only on the positive or negative half-plane of the energy, only positive or negative samples are normalized. Any half-plane can be choosen even if rolling is more profitable (i.e. the pitch estimate is more precise) in the half-plane where the absolute preponderance of the energy exists.

In case of rolling in the positive half-plane the formula used for normalization is:

$$En=trunc\,[(E*255)/32767]\ \text{if}\ E>0,$$

En=0 if E≦0.

In case of rolling in the negative half-plane, the formula used for normalization is:

$$En=trunc\ [(-E*255)/32767] \text{ if } E<0,$$

En=0 if E≧0.

Trunc [. . . ] means the integral part function.

Still in the same example the determination of the first relative or local maximum is realized, at first, by individuating all local maxima of such a sequence of binary values, and therefore, by choosing the one having a maximum binary value. In any case other strategies can be used for such determination following the teachings of the known art without substantially jeopardizing the operation of the method.

In order to speed up the determination of the next relative maximum, it is to advantage to take into account the limits of variability of the human voice pitch illustrated previously; to this end in step d) the most limited interval [INF . . . minfSUP,n+R)] is used; min ( . . . ) means the "minimum of" function. This choice reaches, among other things, the additional effect of making the estimate more reliable. In fact it often happens that e.g. the relative maximum, from which one starts for measuring the pitch, generally is followed, in the subsequent 2 ms, by one or two relative maxima having near equal energy which, without the lower limit equal to INF, would be erroneously individuated and considered as acceptable.

It may be useful to check within the same time interval as the pitch varies; this is obtained in a very simple manner by repeating steps a) to f) and using as a first relative maximum the one that corresponds to said value z determined previously. This can be useful, e.g., when one is not sure that the first relative maximum corresponds to the fundamental frequency and wants to exploit the self-corrective capacities of the method. Naturally in a system for the automatic speech recognition, the pitch estimate must be periodically repeated and, consequently, steps a) to f) are repeated in time intervals of voiced type subsequent to said first time interval.

As said in advance, for the operation of the method, it is necessary that the time interval to which the method is applied is of voiced type. Such a check can be realized through the steps of:

a) verifying if it is of silent type, by controlling that the energy of the speech acoustic signal does not exceed a first threshold in such interval, and b) verifying if it is of unvoiced type, by controlling that, for each sub-interval of predetermined length of such interval, the absolute energy of the speech acoustic signal does not exceed a second threshold, and at the same time that the energy of the speech acoustic signal results is null at a number of time instants greater than a third threshold;

and it has a positive outcome if verifications steps a) and b) have had a negative outcome.

A possible choice for the length of the sub-interval corresponds to 4 ms, for the second threshold it corresponds to 6,000 and, for the third threshold, to 8. The value of the first threshold depends on the background noise.

By using the method in accordance with the present invention a system has been realized for speech recognition based thereupon and suitable for receiving at the input PCM speech acoustic signals, like those used in telephony, with good recognition capacities.

The method has revealed itself very useful not only for the estimate of the speech acoustic signal pitch to be recognized but also for generating the database used by the speech recognition system.

We claim:

1. A method of estimating a pitch of a speech acoustic signal in a time interval in which said speech acoustic signal is a voiced one, characterized in that the pitch corresponds to a distance between contact points of a circle and a plot of energy of said speech acoustic signal as a function of time, the plot being normalized to a limit value, said contact points being obtained by rotating said circle on said plot.

2. A method of estimating a pitch of a speech acoustic signal in a first time interval in which said speech acoustic signal is a voiced one, comprising the steps of a) sampling, according to a sampling period, the energy of the speech acoustic signal to form discrete values and digitizing the discrete values, according to a code, at least in said first time interval, thus obtaining a sequence of binary values, b) normalizing said binary values to a limit value to provide a normalized binary value sequence, c) determining a first relative maximum of said normalized binary value sequence, d) computing h(z) which represents an estimate of pitch of the speech acoustic signal using the formula:

$$h(z)=sqrt\ [R^2-n^2]+E(x)-sqrt\ [R^2-(z-n)^2],$$

where x is the position in said sequence of said first maximum,

E(x) is the energy of the speech acoustic signal representing the binary value of said first relative maximum, R is a radius of the circle having a predetermined value, n is equal to an initial value, for values of z in an interval [1 . . . . n+R], e) checking if there is at least one value of an variable z such that the conditions $$E(x+z)\geqq E(x+z-1),\ E(x+z)\geqq E(x+z+1) \text{ and}$$

$$E(x+z)\geqq h(z) \text{ are met, and}$$

f) repeating steps d) and e) with an increased value of n until such check has a positive outcome of n=R;

whereby, if such check has a positive outcome, said pitch corresponds to the value of the variable z so determined.

3. A method according to claim 2, characterized in that, after having obtained a first pitch value, said steps are repeated, in said first time interval, using the relative maximum, that corresponds to said value z so determined, as the first relative maximum.

4. A method according to claim 2, characterized in that said steps are repeated in voiced time intervals subsequent to said first time interval.

5. A method according to claim 2, characterized in that said limit value is 255 and said step b) is realized according to the formula $$En=trunc[(E*255)/MAX] \text{ if } E>0$$

En=0 if E≧0 where MAX is the absolute value of the maximum positive binary value contemplated by said code.

6. A method according to claim 2, characterized in that said limit value is 255 and said step b) is realized according to the formula $En=trunc\ [(-E*255)/MAX]\ if\ E>0$ $En=0$ if $E \geqq 0$ where MAX is the absolute value of the negative maximum binary value contemplated by said code.

7. A method according to claim 2, characterized in that said step c) is realized, at first, by individuating all the relative maxima of said binary value sequence and then choosing the one having the maximum binary value.

8. A method according to claim 2, characterized in that the method further comprises the steps of using a minimum value INF and a maximum value SUP of the pitch for the human voice, and using an interval in said step d) that corresponds to INF . . . min (SUP,n+R).

9. A method according to claim 8, wherein the minimum value INF equals 2.5 milliseconds and the maximum value SUP equals 2.5 milliseconds.

10. A method according to claim 2, characterized in that the step of checking whether said first time interval is a voiced one comprises the steps of:

a) verifying that said first time interval is of silent type if the energy of the speech acoustic signal does not exceed a first threshold in said interval, and b) verifying that said first time interval is of unvoiced type if for each sub-interval of predetermined length of such interval, an absolute energy of said speech acoustic signal does not exceed a second threshold, and at the same time the energy of said speech acoustic signal is null in a number of time instants greater than a third threshold;

whereby said check has a positive outcome if both verifications of steps a) and b) have had a negative outcome.

11. A method according to claim 2, wherein the radius of the circle R has a value of about 13.25 milliseconds.

12. A method according to claim 2, wherein the initial value n of the variable z has a value of about 1.

13. A method of estimating a pitch of a voice represented by a plot of energy of a speech acoustic signal as a function of time, comprising the steps of:

defining a two-dimensional time-energy region having a tangent contact point (P) on the plot of energy of the speech acoustic signal;

rotating the two-dimensional time-energy region to search for peaks in the energy of the speech acoustic signal and to obtain a peak contact point (Q) on the plot of energy of the speech acoustic signal; and corresponding a distance between the tangent contact point (P) and the peak contact point (Q) to the pitch of the voice.

14. A method according to claim 13, wherein the energy of the speech acoustic signal has a function E(x), where x represents a variable that depends on time.

15. A method according to claim 14, wherein the two-dimensional time-energy region is circular with a center (C), a radius (R), and a center coordinate C=(x, E(x)+R).

16. A method according to claim 15, wherein the tangent contact point (P) has a coordinate P=(x, E(x)).

17. A method according to claim 15, wherein the method further comprises the step of increasing the radius R by a predetermined increment.

18. A method according to claim 13, wherein the method further comprises the step of normalizing the plot of energy of the speech acoustic signal to a limit value.

* * * * *

UNITED STATES PATENT AND TRADEMARK OFFICE

CERTIFICATE OF CORRECTION

PATENT NO. : 5,644,678

DATED : July 1, 1997

INVENTOR(S) : Di Ronza

It is certified that error appears in the above-indentified patent and that said Letters Patent is hereby corrected as shown below:

Title page, and Col 1; "METHOD OF ESTIMATING VOICE PITCH BY ROTATING TWO DIMENSIONAL TIME-ENERGY REGION ON SPEECH ACOUSTIC SIGNAL PLOT" should read -- METHOD OF ESTIMATING VOICE PITCH BY ROTATING TWO-DIMENSIONAL TIME-ENERGY REGION ON SPEECH ACOUSTIC SIGNAL PLOT--

Column 6, line 52, claim 3 recites "maximum, that corresponds to said value z" should read --maximum that corresponds to said value z--

Signed and Sealed this

Thirteenth Day of January, 1998

Bruce Lehman

*Attest:*

BRUCE LEHMAN

*Attesting Officer*

*Commissioner of Patents and Trademarks*